US007841511B2

(12) United States Patent
Fogle

(10) Patent No.: US 7,841,511 B2
(45) Date of Patent: Nov. 30, 2010

(54) CARTON BOTTOM CLOSURE

(75) Inventor: James C. Fogle, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 105 days.

(21) Appl. No.: 12/269,308

(22) Filed: Nov. 12, 2008

(65) Prior Publication Data

US 2009/0121004 A1 May 14, 2009

Related U.S. Application Data

(60) Provisional application No. 60/987,628, filed on Nov. 13, 2007.

(51) Int. Cl.
*B65D 5/10* (2006.01)
*B65D 5/36* (2006.01)

(52) U.S. Cl. ..... 229/117; 229/122.33; 229/185

(58) Field of Classification Search ..... 229/117, 229/122.33, 155, 185
See application file for complete search history.

(56) References Cited

U.S. PATENT DOCUMENTS

| | | | | | |
|---|---|---|---|---|---|
| 2,327,709 | A | * | 8/1943 | Himes | 229/117 |
| 2,332,250 | A | * | 10/1943 | O'Reilly | 229/117 |
| 2,388,190 | A | * | 10/1945 | Smart | 229/117 |
| 2,900,122 | A | * | 8/1959 | Steiner | 229/185 |
| 3,361,326 | A | * | 1/1968 | Croley et al. | 229/122.33 |
| 3,592,337 | A | * | 7/1971 | Phillips, Jr. | 229/185 |
| 3,722,782 | A | * | 3/1973 | Collie | 229/117 |
| 4,354,630 | A | | 10/1982 | Roccaforte | |
| 4,487,359 | A | | 12/1984 | Hemmeter | |
| 5,042,714 | A | | 8/1991 | Hall | |
| 6,079,616 | A | * | 6/2000 | Chinks et al. | 229/117 |

* cited by examiner

*Primary Examiner*—Gary E Elkins
(74) *Attorney, Agent, or Firm*—Womble Carlyle Sandridge & Rice, PLLC

(57) ABSTRACT

A carton has an auto bottom that securely closes the bottom of the carton. A reinforcing blank may be provided in the interior of the carton.

17 Claims, 12 Drawing Sheets

CARTON BOTTOM CLOSURE

CROSS-REFERENCE TO RELATED APPLICATION

This application claims the benefit of U.S. Provisional Application No. 60/987,628, filed Nov. 13, 2007, which is hereby incorporated by reference in its entirety.

BACKGROUND

Cartons are typically shipped in bulk quantities. During shipping, the cartons may be vertically stacked upon each other in order to maximize the amount of product shipped in a particular vessel. The amount of product shipped may depend, however, on the load-bearing capacity of the stacked cartons. It is therefore desirable to produce cartons having high rigidity and/or strength in compression for shipping, and for other purposes such as the protection of the carton contents in general. A conventional method for increasing the strength of a carton is to produce the carton from a blank of a different, stronger board material, or to produce the blank from the same carton material but of greater thickness. Such methods typically increase the costs associated with manufacturing the carton, with the material costs of manufacture generally increasing according to the cost of increasing the strength and/or thickness of the entire blank. Some sections of the blank, however, may not be load-bearing, and the additional costs associated with increasing the strength of non-load bearing sections of the blank are wasted.

In order to facilitate closure of the carton bottoms during erection, cartons can be provided with "auto bottom" closures that close as a carton is set up into a tubular form. Erection of such cartons is faster because gluing of the carton bottoms is not required when the cartons are opened up and loaded with product. Such cartons, however, are typically used to accommodate lighter articles because the auto bottom closures may not sufficiently securely retain heavier articles.

SUMMARY

According to a first aspect of the invention, a carton comprises an auto bottom closure including a plurality of cooperating bottom flaps. Two of the bottom flaps have closure apertures that cooperate with adjacent bottom flaps to close the carton bottom. The closure apertures include projection or "hook" features that act to securely close the carton bottom.

According to a second aspect of the invention, the carton may be formed from a multi-ply carton blank. The multi-ply carton blank comprises a primary blank and one or more reinforcing blanks overlying the primary blank. The reinforcing blanks can be adhered and/or otherwise attached to selected locations on the primary blank in order to increase desirable properties such as, for example, strength and rigidity in the resultant carton. The size and location of the applied reinforcing blanks can be selected, for example, to minimize board use while providing a desired level of increased strength and/or rigidity.

The foregoing and other features, aspects, and advantages of the invention will become more apparent upon review of the detailed description of the preferred embodiments set forth below when taken in conjunction with the accompanying drawing figures, which are briefly described as follows.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
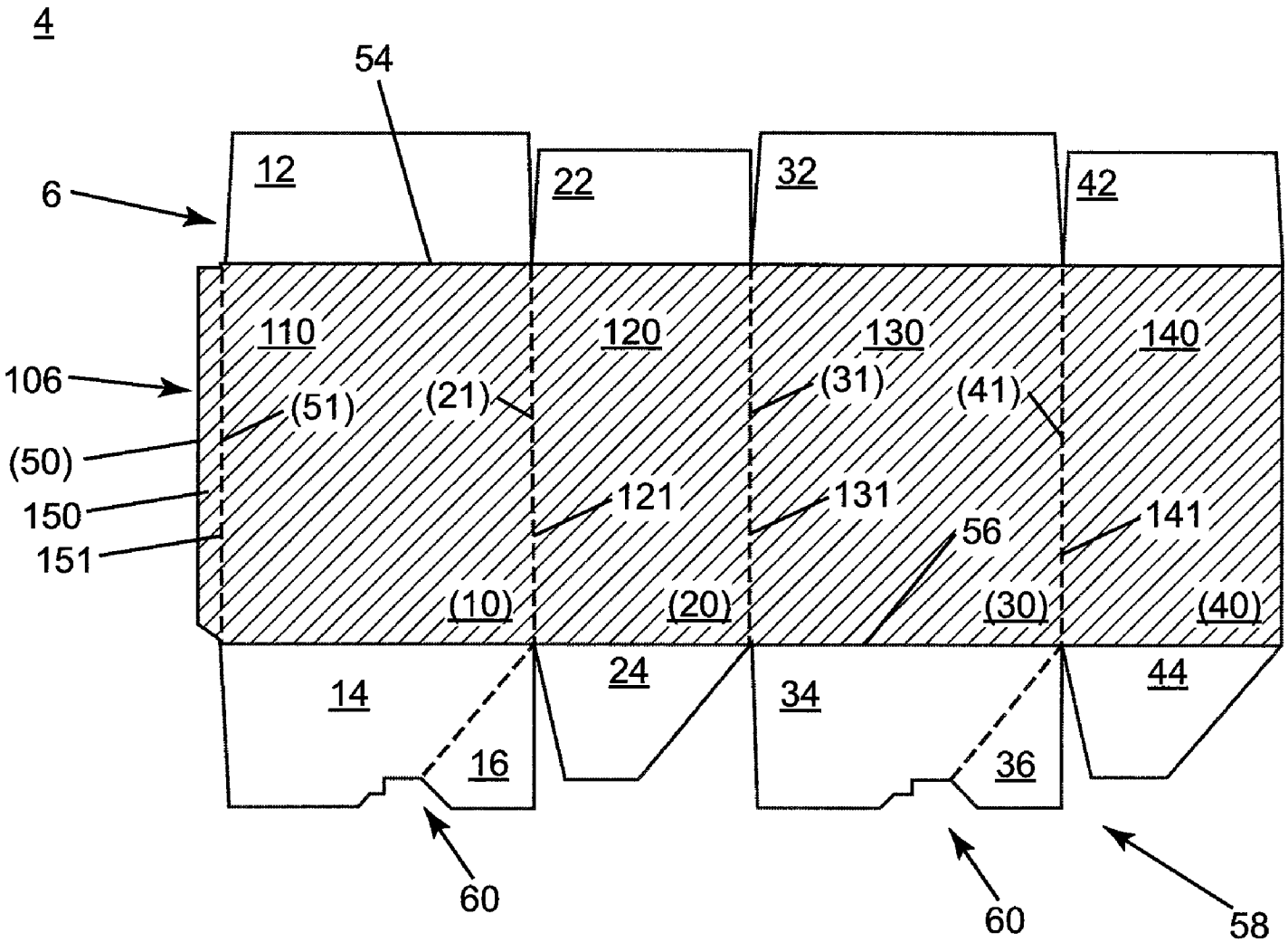
FIG. 1 is a plan view of a blank used to form a carton according to a first embodiment of the invention.

Briefly described, the present invention is directed to cartons having an auto bottom closure that provides a secure closure for the carton contents. FIG. 1 is a plan view of the interior sides of a primary blank 6 and a reinforcing blank 106. The blanks 6, 106 are used to form a carton 200 (illustrated in FIGS. 10 and 11) according to a first embodiment of the invention. The interior sides of the blanks 6, 106 will generally be disposed in the interior of the erected carton 200. The blanks 6, 106 may be combined, for example, into a blank 4 having multi-ply sections formed from adhering the reinforcing blank 106 to the primary blank 6. As discussed in further detail below, the primary blank 6 can have a periphery or "footprint" that is complementary to portions of the periphery of the reinforcing blank 106. In FIG. 1, the reinforcing blank 106 overlies a middle section of the primary blank 6. The diagonal cross-hatch lines indicate possible glue locations for adhering the reinforcing blank 106 to the primary blank 6.

Referring to FIG. 1, the reference numbers of certain elements of the primary blank 6 that are obscured from view by the overlying reinforcing blank 106 are indicated in parentheses. The primary blank 6 comprises a first side panel 10 foldably connected to a second side panel 20 at a first transverse fold line 21, a third side panel 30 foldably connected to the second side panel 20 at a second transverse fold line 31, and a fourth side panel 40 foldably connected to the third side panel 30 at a third transverse fold line 41. An adhesive panel 50 may be foldably connected to the first side panel 10 at a fourth transverse fold line 51.

The reinforcing blank 106 comprises a first side panel 110 foldably connected to a second side panel 120 at a first transversely extending fold line 121, a third side panel 130 foldably connected to the second side panel 120 at a second transverse fold line 131, and a fourth side panel 140 foldably connected to the third side panel 130 at a third transverse fold line 141. An adhesive panel 150 may be foldably connected to the first side panel 110 at a fourth transverse fold line 151. All of the panels 110, 120, 130, 140, 150 or selected ones of the panels reinforcing blank 106 may be adhered to or otherwise secured to respective panels 10, 20, 30, 40 of the primary blank 6.

The first side panel 10 is foldably connected to a first top flap 12, the second side panel 20 is foldably connected to a second top flap 22, the third side panel 30 is foldably connected to a third top flap 32, and the fourth side panel 40 is foldably connected to a fourth top flap 42. The top flaps 12, 22, 32, 42 can be foldably connected at a longitudinal fold line 54. The longitudinal fold line 54 may be straight, or offset at one or more locations to account for, for example, blank thickness.

According to one aspect of the invention, a bottom closure 58 is provided at a lower marginal area of the blank. The bottom closure 58 comprises a first major bottom flap 14 foldably connected to the first side panel 10, a first minor bottom flap 24 foldably connected to the second side panel 20, a second major bottom flap 34 foldably connected to the third side panel 30, and a second minor bottom flap 44 foldably connected to the fourth side panel 40. The bottom flaps 14, 24, 34, 44 of the bottom closure 58 can be foldably connected at a longitudinal fold line 56. The longitudinal fold line 56 may be straight, or offset at one or more locations to account for, for example, blank thickness. The major bottom flaps 14, 34 include closure features 60 struck from end edges of the primary blank 6. A detailed illustration of a portion of the bottom closure 58 at the bottom flaps 14 and 24 is shown in FIG. 2.

Figure 2:
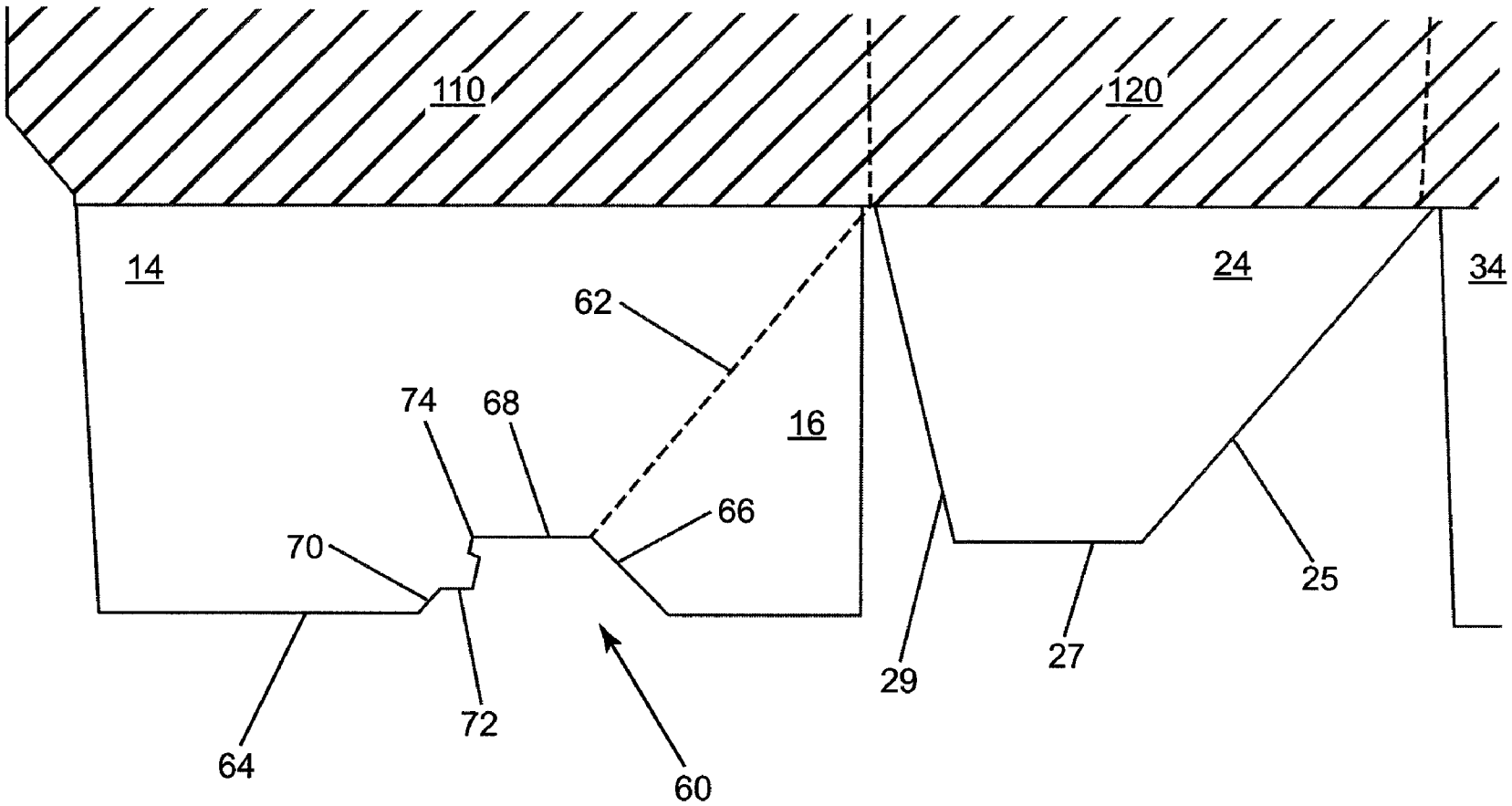
FIG. 2 is an isolated view of a portion of the bottom closure of the blank of FIG. 1.

Referring to FIG. 2, the first minor bottom flap 24 includes a pair of oblique edges 25, 29 connected by a longitudinally extending end edge 27. The second minor bottom flap 44 can be identical or substantially identical to the first minor bottom flap 14. The closure feature 60 in the major bottom flap 14 is an open aperture formed by an oblique edge 66, a longitudinal interior edge 68, a notch recess 74, a projection 72, an oblique edge 70 extending away from the projection 72, and a longitudinally extending exterior edge 64. An oblique crease fold line 62 can be formed in the bottom flap 14 to define a foldable or hinged section 16 in the flap 14.

FIGS. 3-9A illustrate folding and gluing and erection of the multi-ply blank 4 into the carton 200. Closure of the carton bottom is shown in FIGS. 5-8. Certain elements of the blanks 6, 106 referred to in the following description may not be visible in FIGS. 3-9A, and such elements can be found in FIG. 1.

Figure 3:
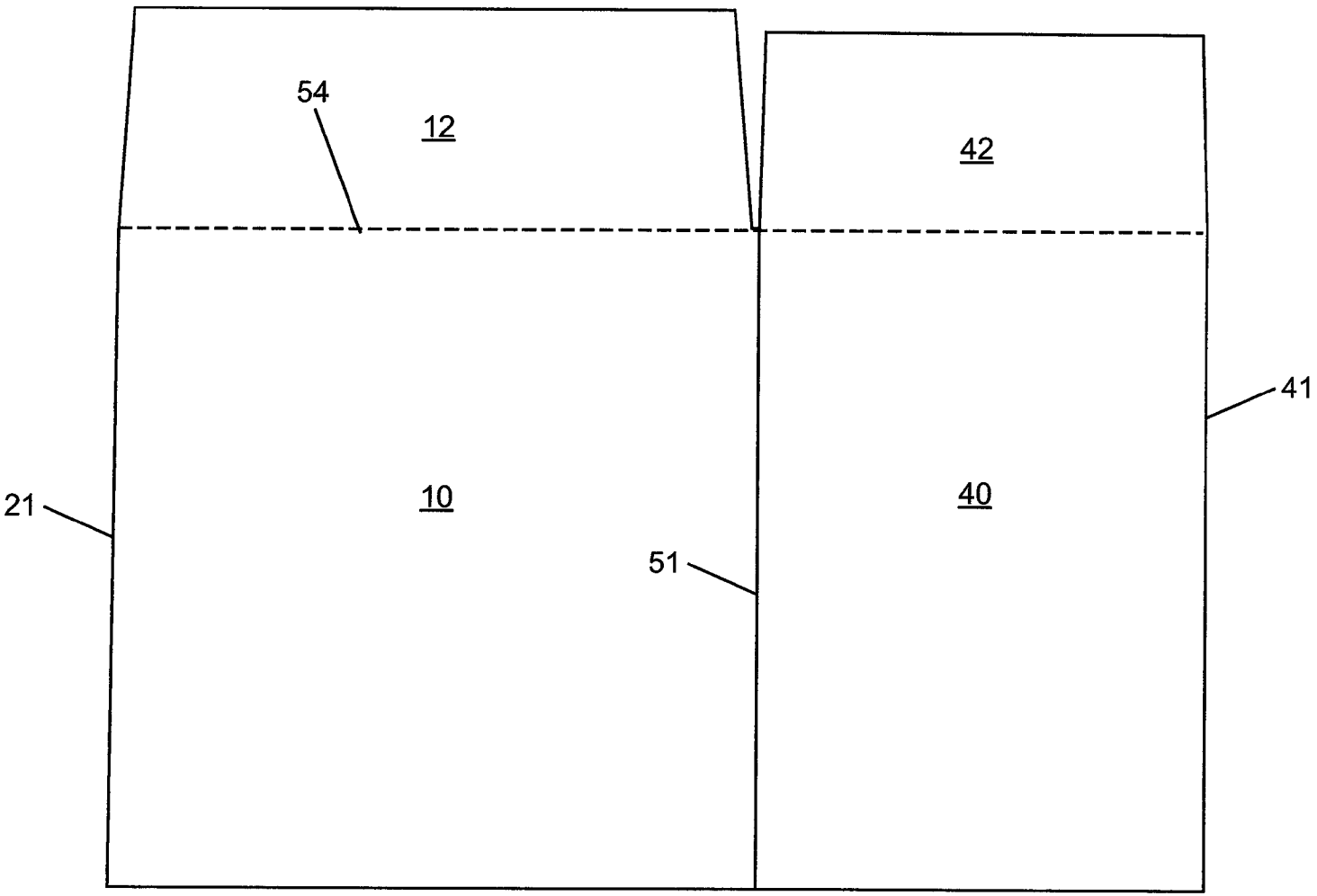
FIGS. 3 and 4 illustrate folding and gluing of the blank of FIG. 1.
Figure 4:
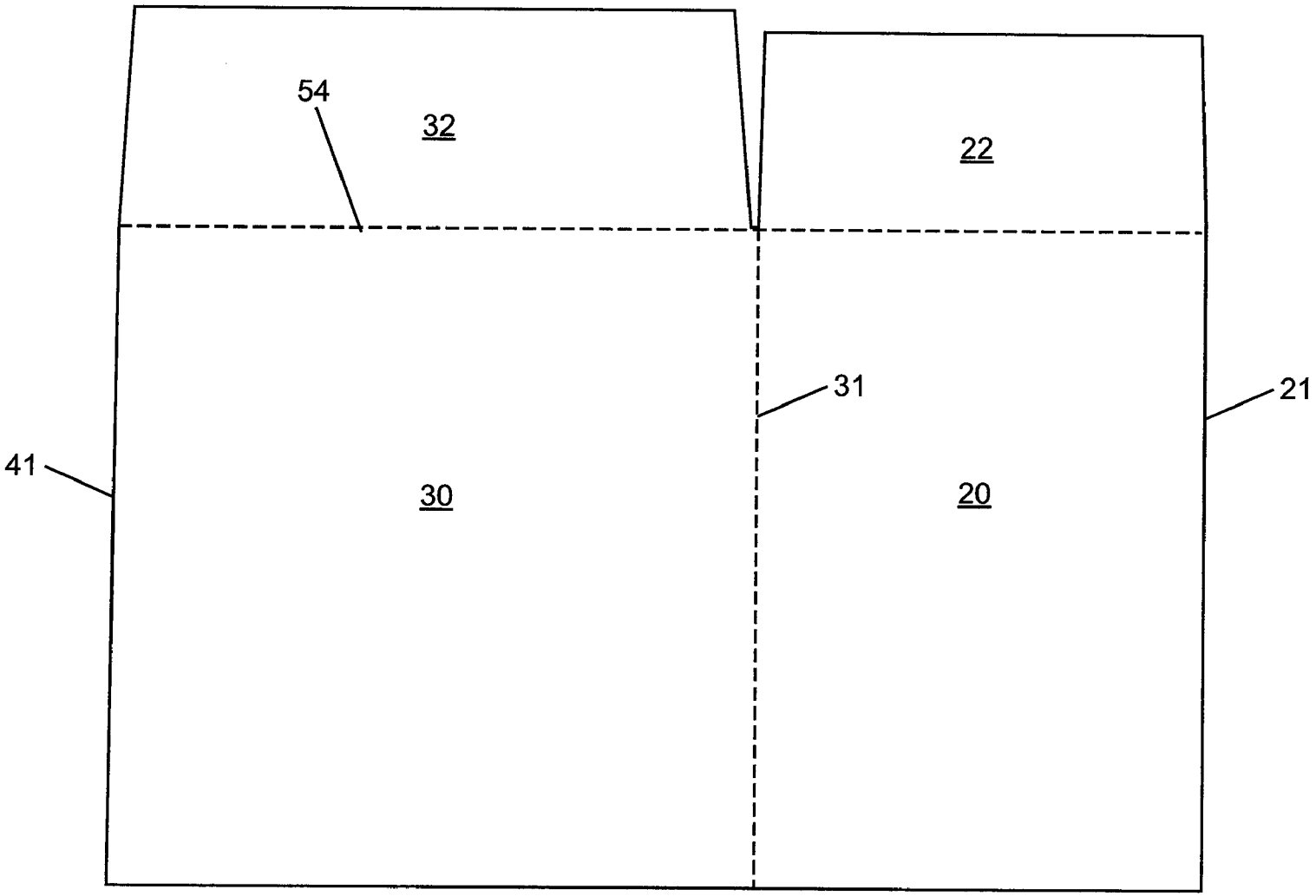

Referring to FIG. 3, the blank 4 is folded about the transverse fold lines 21, 41 so that the exterior side of the adhesive flap 50 can be adhered to an interior side of the side panel 140. The sections 16, 36 of the major bottom flaps 14, 34, respectively, are folded back about creases 62 and the interior sides of the sections 16, 36 are adhered to the minor bottom flaps 24, 44, respectively. FIG. 4 illustrates the opposite side of the glued blank 4.

Figure 5:
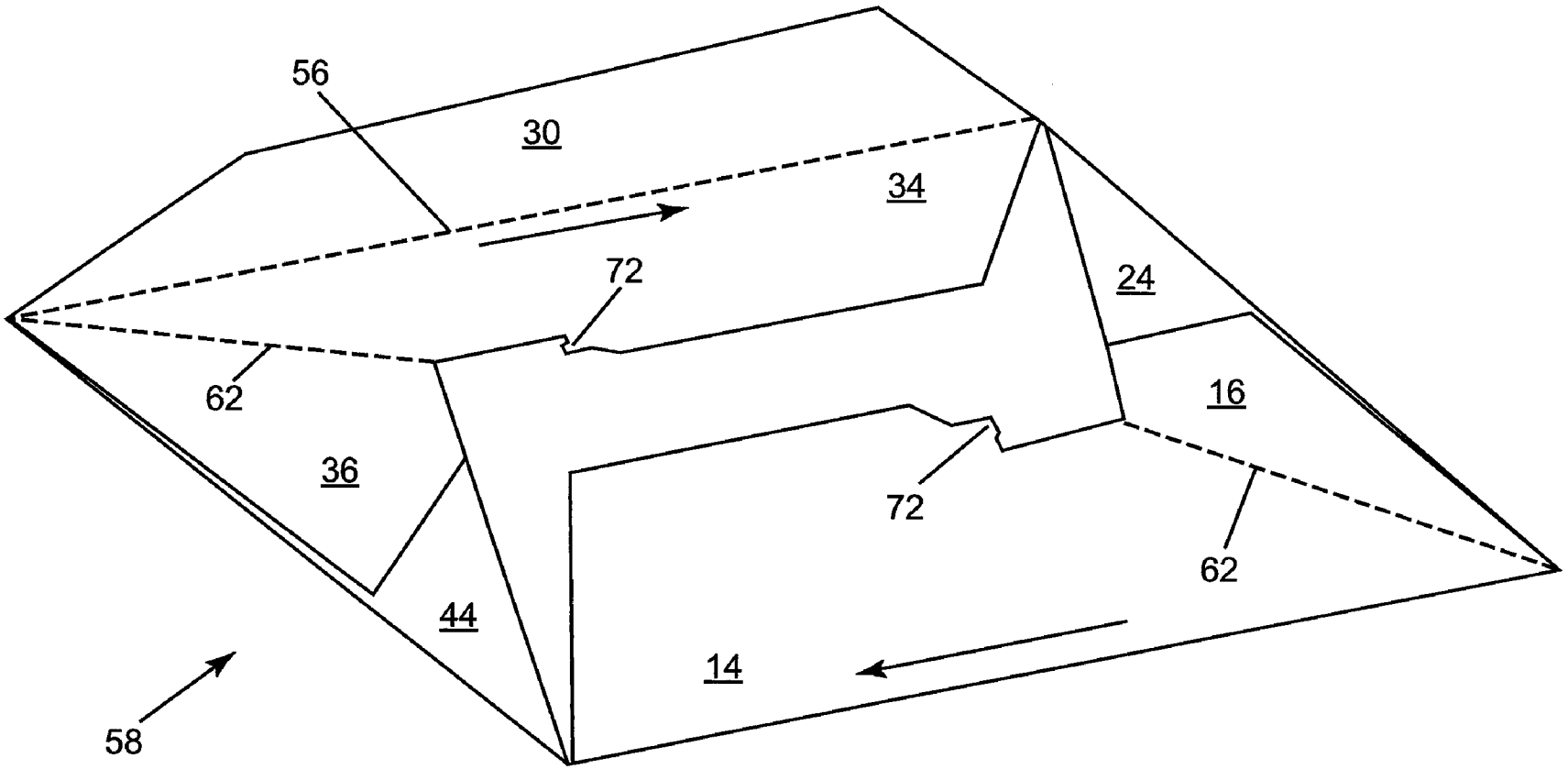
FIGS. 5-8 illustrate closure of the carton bottom.
Figure 6:
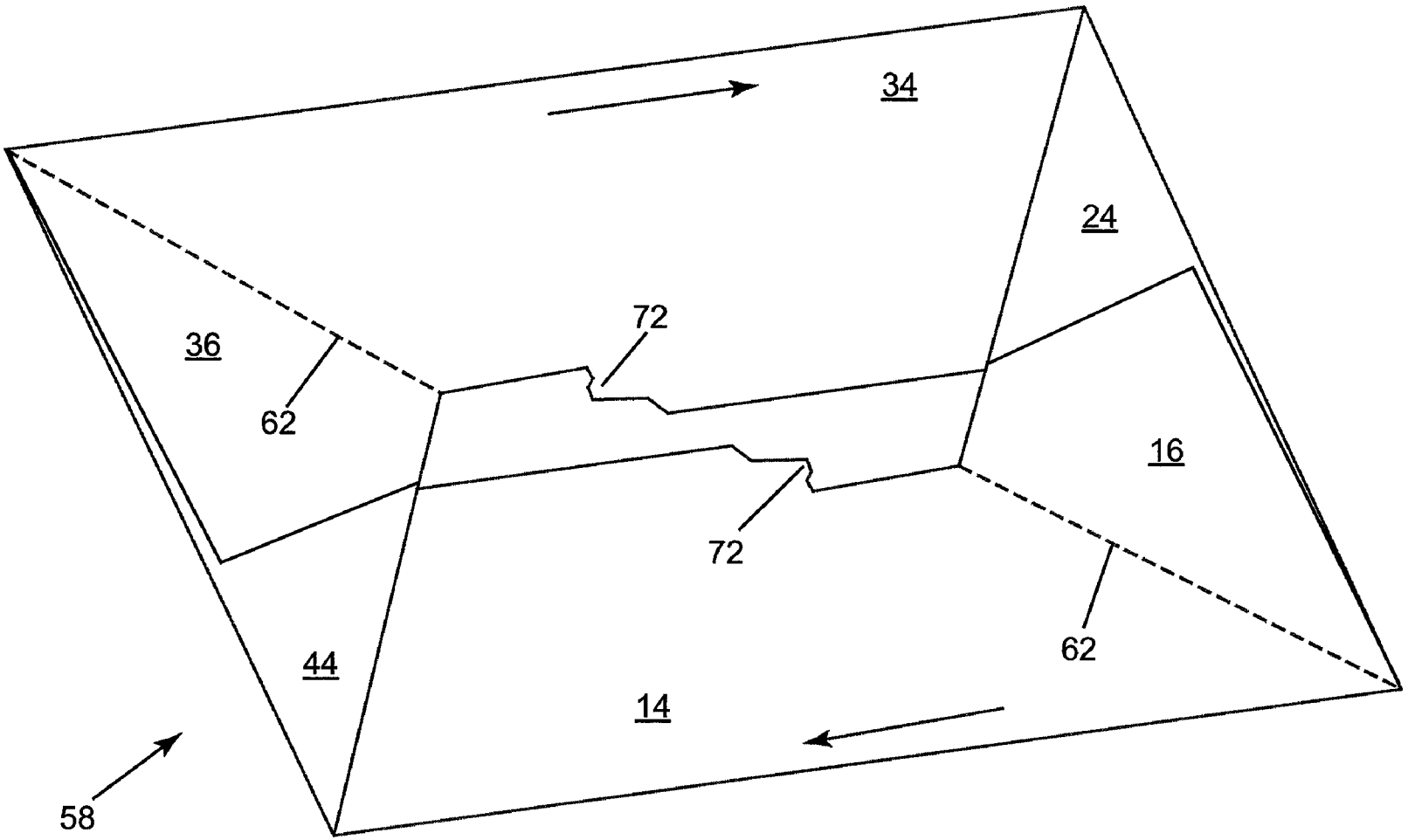

Referring to FIG. 5, the glued blank 4 is opened up into a generally tubular form, which moves the side panels 10, 30 and attached major bottom flaps 14, 34 generally in the direction indicated by the bold arrows. FIG. 6 illustrates further opening up of the tubular carton form.

Figure 7:
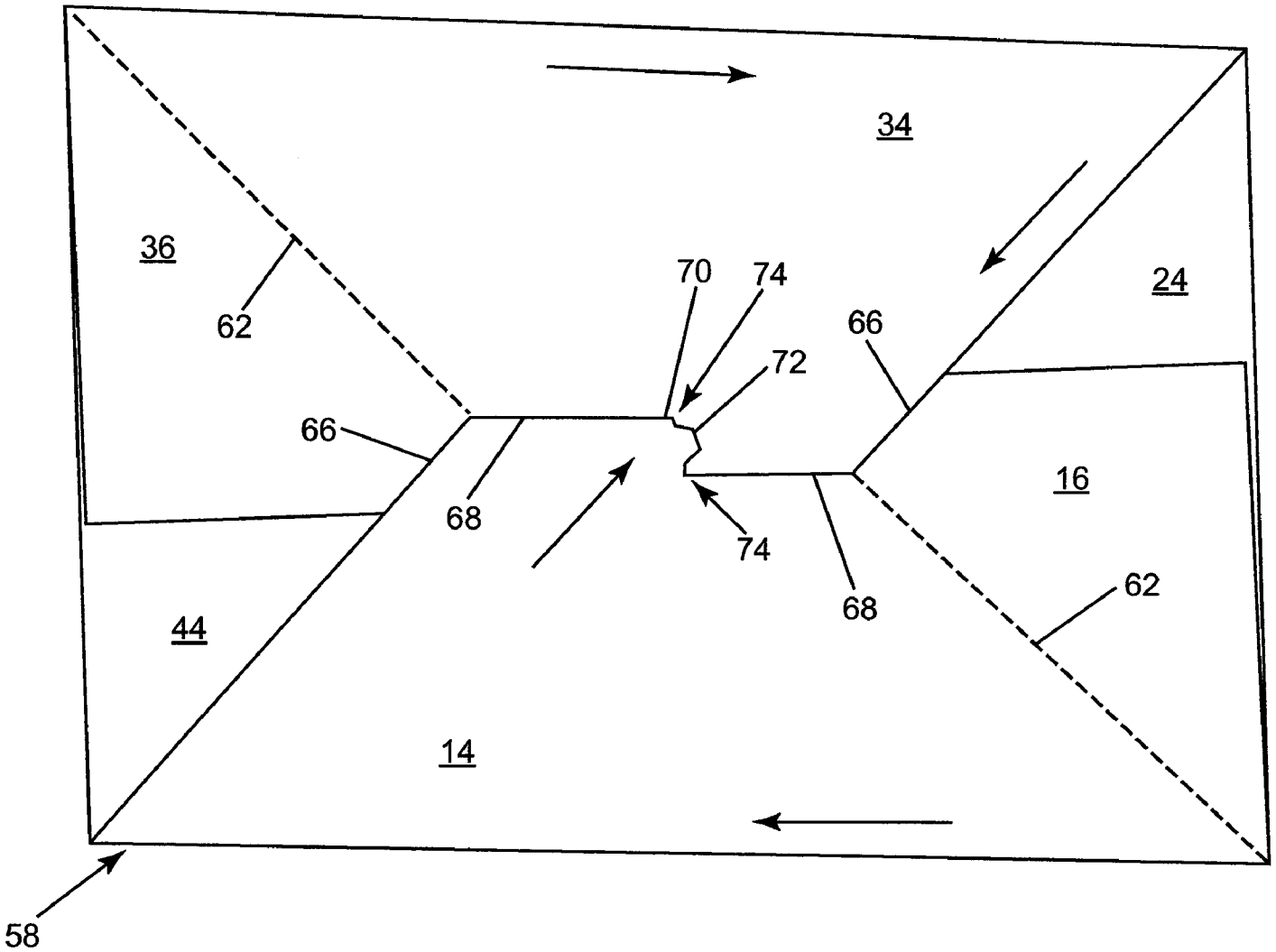
Figure 8:
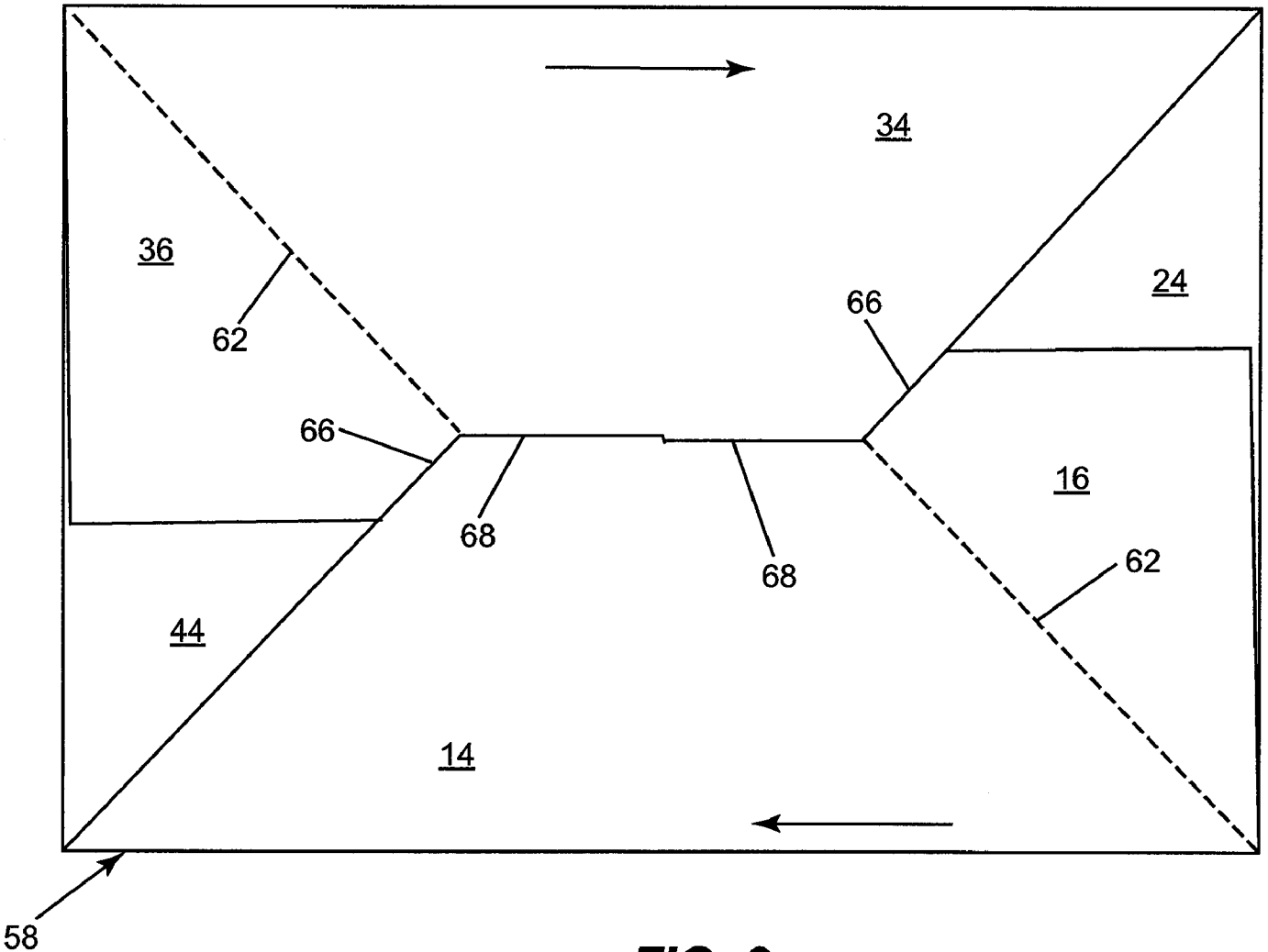
Figure 9A:
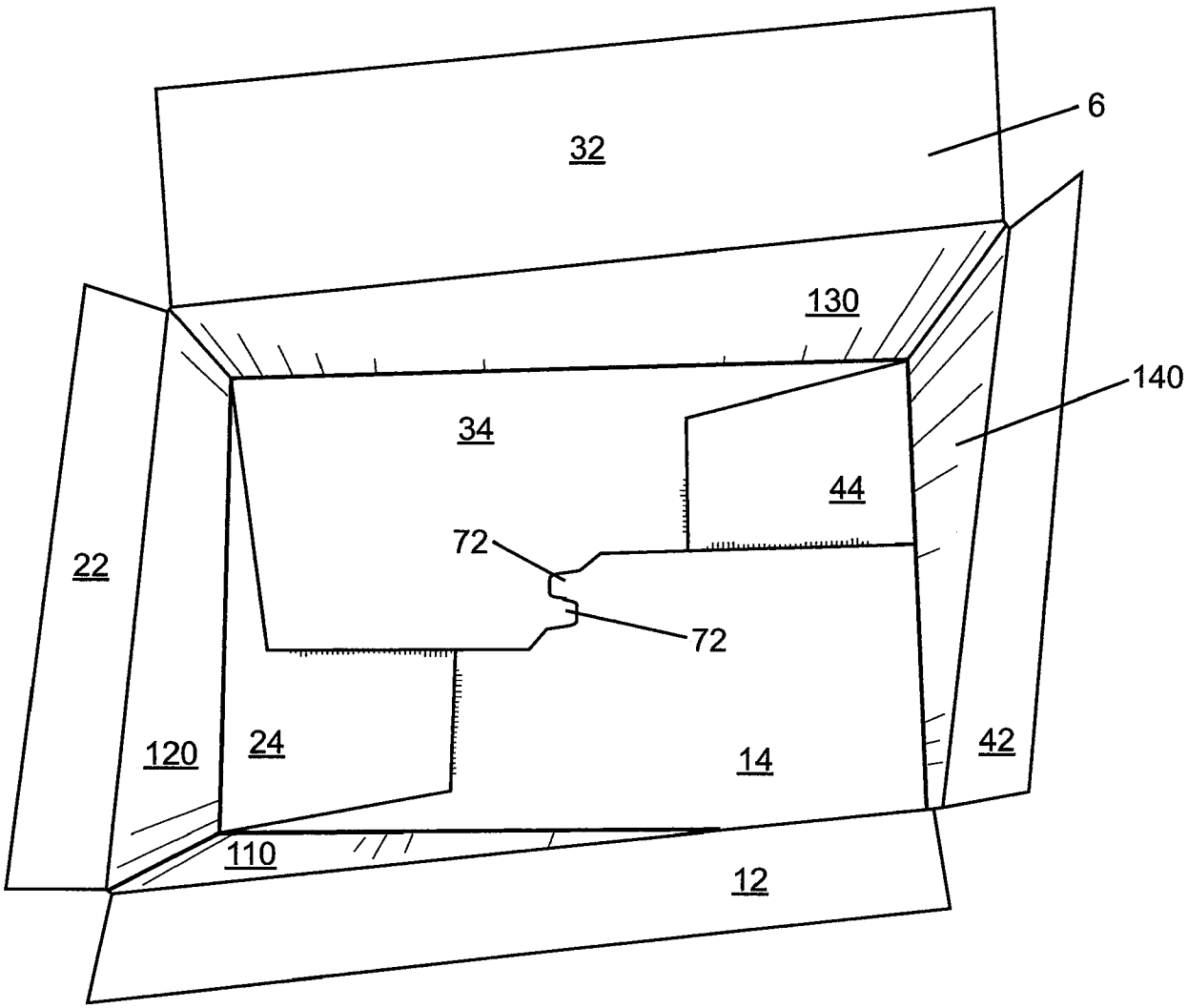
FIG. 9A is a view of the interior of the partially erected carton showing the closed bottom.

Referring to FIG. 7, the partially erected carton form is further opened up so that the closure features 60 in the opposed major bottom flaps 14, 34 engage one another. Referring also to FIG. 8, the carton is squared up so that the projection 72 on the major bottom flap 14 engages the notch 70 in the major bottom flap 34. The projection 72 on the major bottom flap 34 likewise engages the notch 70 in the major bottom flap 14. The bottom closure 58 is accordingly secured in FIG. 8. FIG. 9A illustrates the interior of the set up carton in which the adjacent locking or hook projections 72 are visible.

Figure 9B:
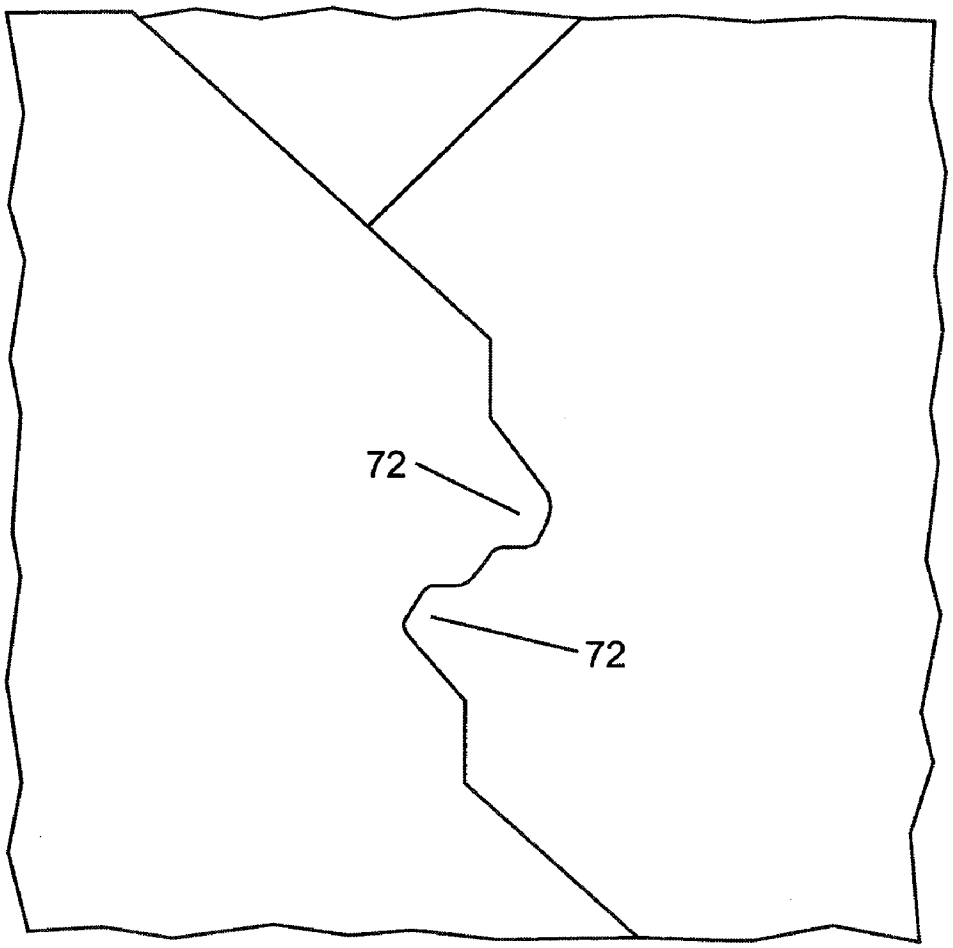
FIG. 9B is an enlarged view of the closed bottom.

FIG. 9B is an enlarged view of the interior of the closed bottom of the carton illustrating adjacent hook projections 72.

Figure 10:
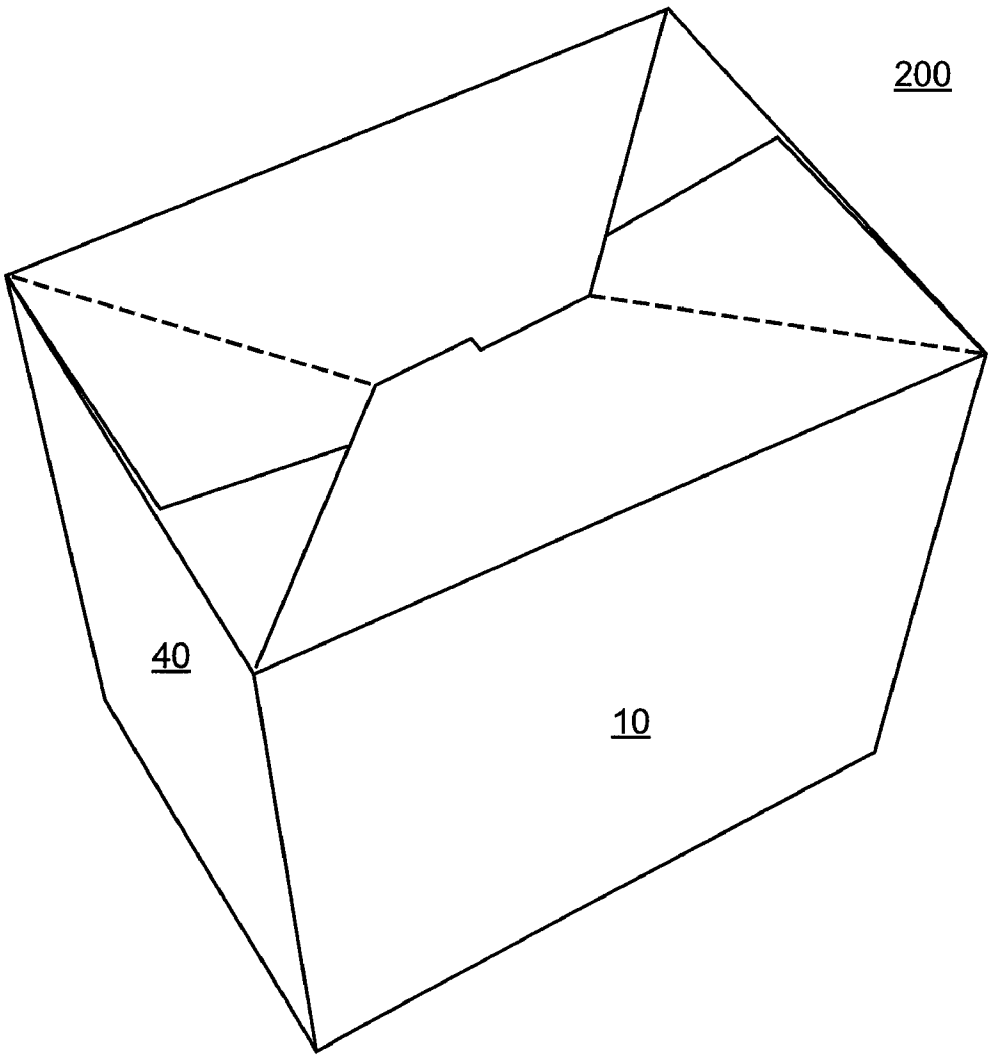
FIG. 10 is a view of the bottom of the carton.
Figure 11:
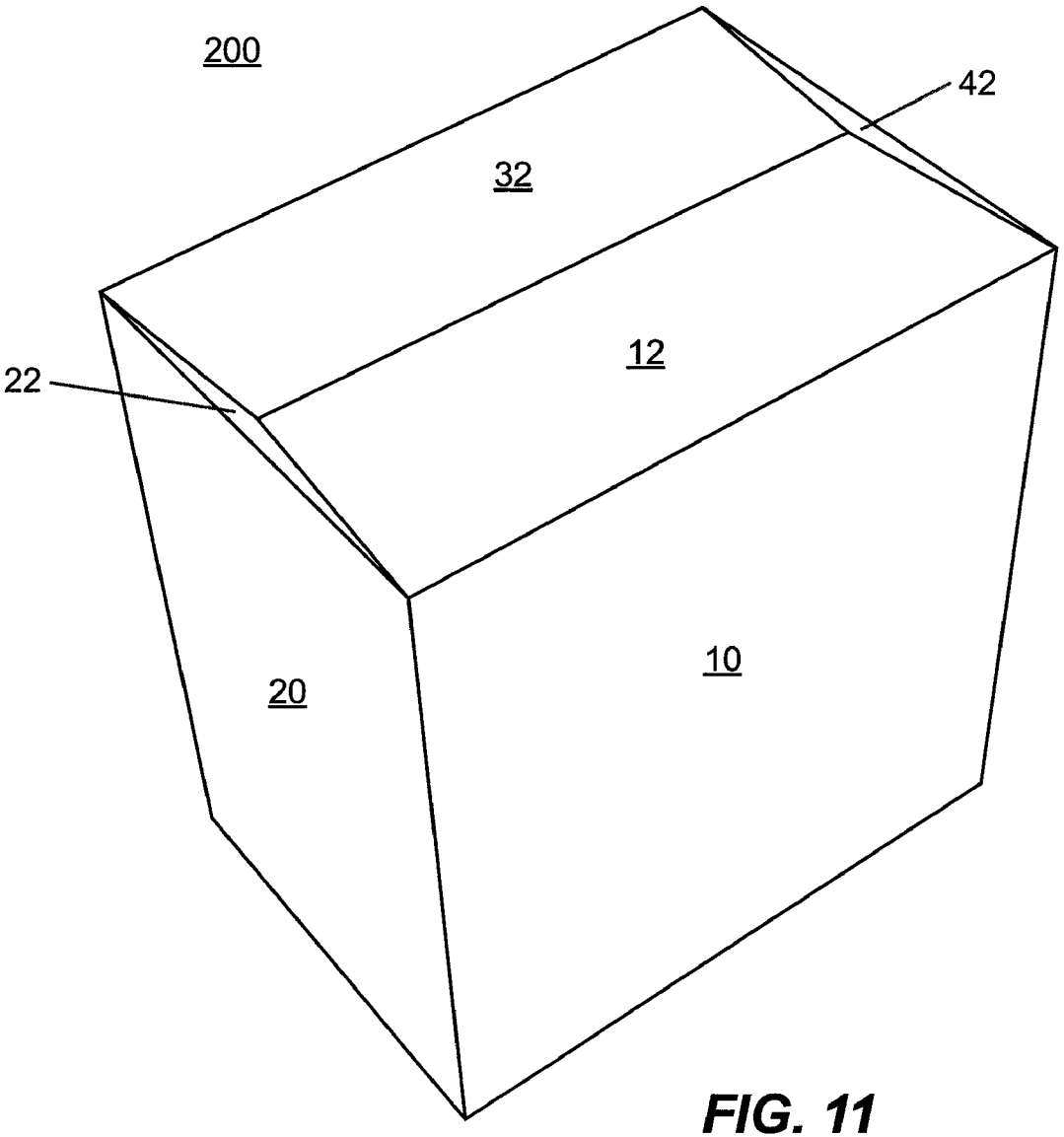
FIG. 11 is a view of the top of the carton.

Referring back to FIG. 9A, the top of the carton can be closed by folding the top flaps 22, 42 inwardly and adhering the top flaps 12, 32 to the upper surfaces of the top flaps 22, 42. FIGS. 10 and 11 illustrate the erected carton 200.

In accordance with the exemplary embodiments, the carton may be constructed of paperboard, for example. The blanks, and thus the carton, can also be constructed of other materials, such as cardboard, solid unbleached sulfate (SUS) board, or any other material having properties suitable for enabling the carton to function at least generally as described above.

In one exemplary embodiment, the primary and reinforcing blanks are formed from SUS board. The primary blank has a caliper in the range of about 14-30 point, which may be more specifically in the range of about 18-26 point. The caliper of the reinforcing blanks can be slightly less than the primary blank, and can be in the range of about 14-20 point.

The blanks can also be laminated to or coated with one or more additional sheet-like materials at selected panels or panel sections. One or more panels of the blanks discussed above can be coated with varnish, clay, or other materials, either alone or in combination. The coating may then be printed over with product, advertising, and other information or images. The blanks may also be coated to protect any information printed on the blanks. The blanks may be coated with, for example, a moisture barrier layer, on either or both sides of the blanks.

In accordance with the above-described embodiments of the present invention, a fold line can be any substantially linear, although not necessarily straight, line of disruption or other form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

In the present specification, a "panel" or "flap" need not be flat or otherwise planar. A "panel" or "flap" can, for example, comprise a plurality of interconnected generally flat or planar sections.

The above embodiments may be described as having one or more panels adhered together by glue. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art, without departing from the spirit and scope of the invention and its equivalents as set forth in the following claims.

What is claimed is:

1. A carton blank comprising:

first, second, third and fourth side panels, each having a top edge and a bottom edge;

a top flap foldably connected to the top edge of at least one of the first side panel, the second side panel, the third side panel, or the fourth side panel;

a major bottom flap foldably connected to the bottom edge of each of the first and third side panels;

a minor bottom flap foldably connected to the bottom edge of each of the second and fourth side panels; and each major bottom flap including a longitudinal exterior edge at which a closure feature is located, the longitudinal exterior edge extending substantially parallel to the bottom edge;

each closure feature comprising an open aperture formed by a first edge extending from the longitudinal exterior edge to a longitudinal interior edge, a notch recess, a projection, and an oblique edge extending from the projection to the longitudinal exterior edge;

the projection being defined by an edge which extends a first distance from the oblique edge in a first direction substantially parallel to the bottom edge, then in a second direction toward the bottom edge, then in a third direction to the notch recess, the third direction being substantially parallel to the first direction;

the closure features being engageable when a carton is erected from the blank, thereby forming with the minor bottom flaps a closure for the bottom of the carton.

2. The carton blank of claim 1, wherein the notch recess of each closure feature is engageable with the projection of the other closure feature.

3. The carton blank of claim 1, wherein each major bottom flap includes an oblique fold line defining a hinged section.

4. The carton blank of claim 1, wherein the first edge is oblique to the longitudinal exterior edge.

5. The carton blank of claim 1, including a reinforcing blank secured to at least one of the side panels.

6. The carton blank of claim 5, wherein the reinforcing blank overlies the first, second, third and fourth side panels.

7. A method of forming a carton from the carton blank of claim 1, the method comprising the steps of:

attaching the first and fourth side panels together at their side edges;

opening the attached side panels up into a generally tubular form; and engaging the closure features with each other, whereby the major and minor bottom flaps form a closure for the bottom of the carton.

8. The method of claim 7, wherein the closure features are engaged by engaging the notch recess of each closure feature with the projection of the other closure feature.

9. The method of claim 7, wherein each major bottom flap includes an oblique fold line defining a hinged section, and each hinged section is attached to the adjacent minor bottom flap before opening the attached side panels up into a generally tubular form.

10. The method of claim 7, wherein opening the attached side panels up into a generally tubular form causes the closure features to engage each other.

11. A carton formed from the carton blank of claim 1.

12. A carton which is the product of the method of claim 7.

13. A carton blank for forming a carton, the blank comprising:

a sheet of material having a top edge, a bottom edge and two side edges;

at least first, second, third and fourth side panels defined by upper and lower longitudinal fold lines and a plurality of transverse fold lines;

a plurality of top flaps located at the tops of the side panels, between the upper longitudinal fold line and the top edge of the sheet;

a major bottom flap located at the bottom of at least two of the side panels, between the lower longitudinal fold line and the bottom edge of the sheet;

a minor bottom flap located at the bottom of at least another two of the side panels, between the lower longitudinal fold line and the bottom edge of the sheet;

each major bottom flap including a longitudinal exterior edge at which a closure feature is located, the longitudinal exterior edge extending substantially parallel to the lower longitudinal fold line;

each closure feature comprising an open aperture formed by a first edge extending from the longitudinal exterior edge to a longitudinal interior edge, a notch recess, a projection, and an oblique edge extending from the projection to the longitudinal exterior edge;

the projection being defined by an edge which extends a first distance from the oblique edge in a first direction substantially parallel to the longitudinal exterior edge, then in a second direction toward the lower longitudinal fold line, then in a third direction to the notch recess, the third direction being substantially parallel to the first direction; and the closure features being interengageable in response to erection of the blank to form a bottom closure for the carton comprising the major bottom flaps and minor bottom flaps.

14. The carton blank of claim 13, wherein the first edge is oblique to the longitudinal exterior edge.

15. The carton blank of claim 13, including a hinged section on at least one major bottom flap, the hinged section being attachable to the adjacent minor bottom flap.

16. The carton blank of claim 15, wherein the hinged section is defined by an oblique fold line in the major bottom flap.

17. A carton formed from the carton blank of claim 13.

* * * * *